US005519425A

United States Patent [19]

Dietl et al.

[11] Patent Number: 5,519,425

[45] Date of Patent: May 21, 1996

[54] INK SUPPLY CARTRIDGE FOR AN INK JET PRINTER

[75] Inventors: Steven J. Dietl, Ontario; Vladimir M. Kupchik, Pittsford; Manfred H. Goeserich, Churchville, all of N.Y.

[73] Assignee: Xerox Corporation, Stamford, Conn.

[21] Appl. No.: 151,625

[22] Filed: Nov. 15, 1993

[51] Int. Cl.[6] ..... B41J 2/175

[52] U.S. Cl. ..... 347/87

[58] Field of Search ..... 347/86, 87, 58, 347/93, 63; 156/273.5; 428/462

[56] References Cited

U.S. PATENT DOCUMENTS

| | | | |
|---|---|---|---|
| 4,254,186 | 3/1981 | Acitelli et al. | 428/462 |
| 4,392,907 | 7/1983 | Shirato et al. | 347/63 |
| 4,463,359 | 7/1984 | Ayata et al. | 346/1.1 |
| 4,638,337 | 1/1987 | Torpey et al. | 346/140 R |
| 4,751,527 | 6/1988 | Oda | 346/140 R |
| 4,771,295 | 9/1988 | Baker et al. | 346/1.1 |
| 4,774,530 | 9/1988 | Hawkins | 346/140 R |
| 4,791,438 | 12/1988 | Hanson | 346/140 R |
| 4,922,269 | 5/1990 | Ikeda et al. | 347/58 |
| 5,221,397 | 6/1993 | Nystrom | 156/273.5 |
| 5,233,369 | 8/1993 | Carlotta et al. | 346/140 R |
| 5,289,212 | 2/1994 | Carlotta | 347/87 |

FOREIGN PATENT DOCUMENTS

| | | | |
|---|---|---|---|
| 174371 | 10/1982 | Japan . | |
| 203763 | 8/1989 | Japan . | |
| 207662 | 9/1991 | Japan | 347/93 |
| 162321 | 6/1993 | Japan | 347/93 |

OTHER PUBLICATIONS

Xerox Disclosure Journal, vol. 16, No. 4, Jul./Aug. 1991, p. 233.

*Primary Examiner*—N. Le

[57] ABSTRACT

An ink cartridge for an ink jet printer has an ink supply in a housing and a printhead assembly fixedly attached thereto. The ink is contained in an absorbent material in the housing which is partitioned from the printhead assembly by a housing wall having a vent and an ink outlet. The ink flow path from the housing outlet to the printhead inlet is produced by a recess in the outer surface of the housing wall and a film member bonded thereover by a thermosetting adhesive. The film member has a slot therethrough, and the adhesive is the type not attacked by the ink. The surface of the film member opposite the surface bonded to the housing wall is coated with the same thermosetting adhesive which bonds to the printhead assembly surface containing the ink inlet. The printhead assembly ink inlet is of similar size and aligned with the film member slot, so that the thermosetting adhesive assists in the attachment of the printhead assembly to the housing and concurrently provides the fluid seal between the housing and the printhead assembly.

11 Claims, 5 Drawing Sheets

INK SUPPLY CARTRIDGE FOR AN INK JET PRINTER

BACKGROUND OF THE INVENTION

This present invention relates to a cartridge for supplying liquid ink to a printhead in a thermal ink jet printing apparatus.

In existing thermal ink jet printing, the printhead comprises one or more ink filled channels, such as disclosed in U.S. Pat. No. 4,463,359, communicating with a relatively small ink supply chamber, or reservoir, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and resistor starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper. Because the droplet of ink is emitted only when the resistor is actuated, this general type of thermal ink jet printing is known as "drop-on-demand" printing.

The printhead of U.S. Pat. No. 4,463,359 has one or more ink-filled channels which are replenished by capillary action. A meniscus formed at each nozzle, in combination with a slightly negative ink pressure, prevents ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. The current pulses to the heater are shaped to prevent the meniscus from breaking up and receding too far into the channels after each droplet is expelled. Various embodiments of linear arrays of thermal ink jet devices are known, such as those having staggered linear arrays attached to the top and bottom of a heat sinking substrate and those having different colored inks for multiple colored printing.

A common type of printhead is known as a "sideshooter." Sideshooters are so named because the ink droplets are emitted through the channel at a right angle relative to the heating element. U.S. Pat. No. 4,774,530 describes such a construction in greater detail. U.S. Pat. No. 4,638,337 describes a sideshooter in which the sudden release of vaporized ink known as blowout is prevented by disposing the heater in a recess.

In current practical embodiments of drop-on-demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure," exist in each of the nozzles and, by extension, within the ink supply manifold of the printhead. A discussion of desirable ranges for back pressure in thermal ink jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the copy surface. Such weeping will obviously have adverse results on copy quality, as liquid ink leaks out of the printhead uncontrollably.

A typical end-user product in this art is a cartridge in the form of a prepackaged, usually disposable item comprising a sealed container holding a supply of ink and, operatively attached thereto, a printhead having a linear or matrix array of channels. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead against the sheet on which an image is to be rendered, and is then moved across the sheet periodically, in swaths, to form the image, much like a typewriter. Full-width linear arrays, in which the sheet is moved past a linear array of channels which extends across the full width of the sheet, are also known. Typically, cartridges are purchased as needed by the consumer and used either until the supply of ink is exhausted, or, equally if not more importantly, until the amount of ink in the cartridge becomes insufficient to maintain the back pressure of ink to the printhead within the useful range.

Other considerations are crucial for a practical ink supply as well. The back pressure, for instance, must be maintained at a usable level for as long as possible while there is still a supply of ink in an ink cartridge. Therefore, a cartridge must be so designed as to maintain the back pressure within the usable range for as large a proportion of the total range of ink levels in the cartridge as possible. Failure to maintain back pressure causes the ink remaining in the cartridge to leak out through the printhead or otherwise be wasted.

U.S. Pat. No. 5,233,369 discloses an ink-supply cartridge wherein two chambers are provided, the upper chamber having a capillary foam and the lower chamber substantially filled with ink. The printhead is disposed at a vertical height greater than the top level of the lower chamber. A second capillary foam, disposed along the supply line to the printhead, has a capillarity greater than that of the foam in the upper chamber. In another embodiment, only one chamber, corresponding to the lower chamber in the first embodiment and having no capillary foam therein, is provided.

In earlier patents, felt substances have been used for the control of the flow of liquid ink. For example, U.S. Pat. No. 4,751,527 describes an ink jet "typeprinter" in which a plurality of holes are formed in a film and then filled with ink. Selectively heating areas of the film generates bubbles in the ink and ejects the ink due to the pressure of the bubbles, thus printing an image on a sheet. In order to convey the ink to the film at the beginning of the process, felt ink supply members are employed to act as wicks for the gradual flow of ink into the film.

U.S. Pat. No. 4,771,295 discloses an ink-supply cartridge construction having multiple ink storage compartments. Ink is stored in a medium of reticulated polyurethane foam of controlled porosity and capillarity. The medium empties into ink pipes, which are provided with wire mesh filters for filtering of air bubbles and solid particles from the ink. The foam is also compressed to reduce the pore size therein, thereby reducing the foam thickness while increasing its density; in this way, the capillary force of the foam may be increased.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

SUMMARY OF THE INVENTION

In accordance with one aspect of the present invention, a cartridge for supplying liquid ink to a thermal ink jet printing apparatus comprises a housing defining a single chamber having a wall with a ventilation port and an outlet port covered by a filter. An absorbent medium occupies at least a portion of the chamber, the absorbent medium being adapted to retain a quantity of liquid ink. A scavenger member of absorbent material is disposed across the outlet port, providing a capillary force greater than that of the absorbent medium. An ink passageway is formed when an elongated recess in the external surface of the housing wall is covered by a shaped thin polyester film having a predetermined geometry and a thermosetting adhesive on both sides. A small slot in the shaped film serves as an outlet from the passageway and is aligned with and seals the printhead inlet. The printhead is bonded to a heat sink which is, in turn, fixed to the cartridge wall by integral posts extending therefrom. Locator holes in the heat sink are used to guide the posts therethrough to align the heat sink and the printhead so that the printhead inlet is registered with the shaped film slot. The posts are bonded and staked to the heat sink, so that the printhead, which is bonded to the heat sink, is fixed to the cartridge wall, and then the thermosetting adhesive is cured to bond the printhead to the cartridge wall and to form a permanent seal around the slot in the shaped film and the printhead inlet.

BRIEF DESCRIPTION OF THE DRAWINGS

By way of example, an embodiment of the invention will be described with reference to the accompanying drawings, wherein like numerals indicate like parts, in which.

DESCRIPTION OF THE PREFERRED EMBODIMENT

Figure 1:
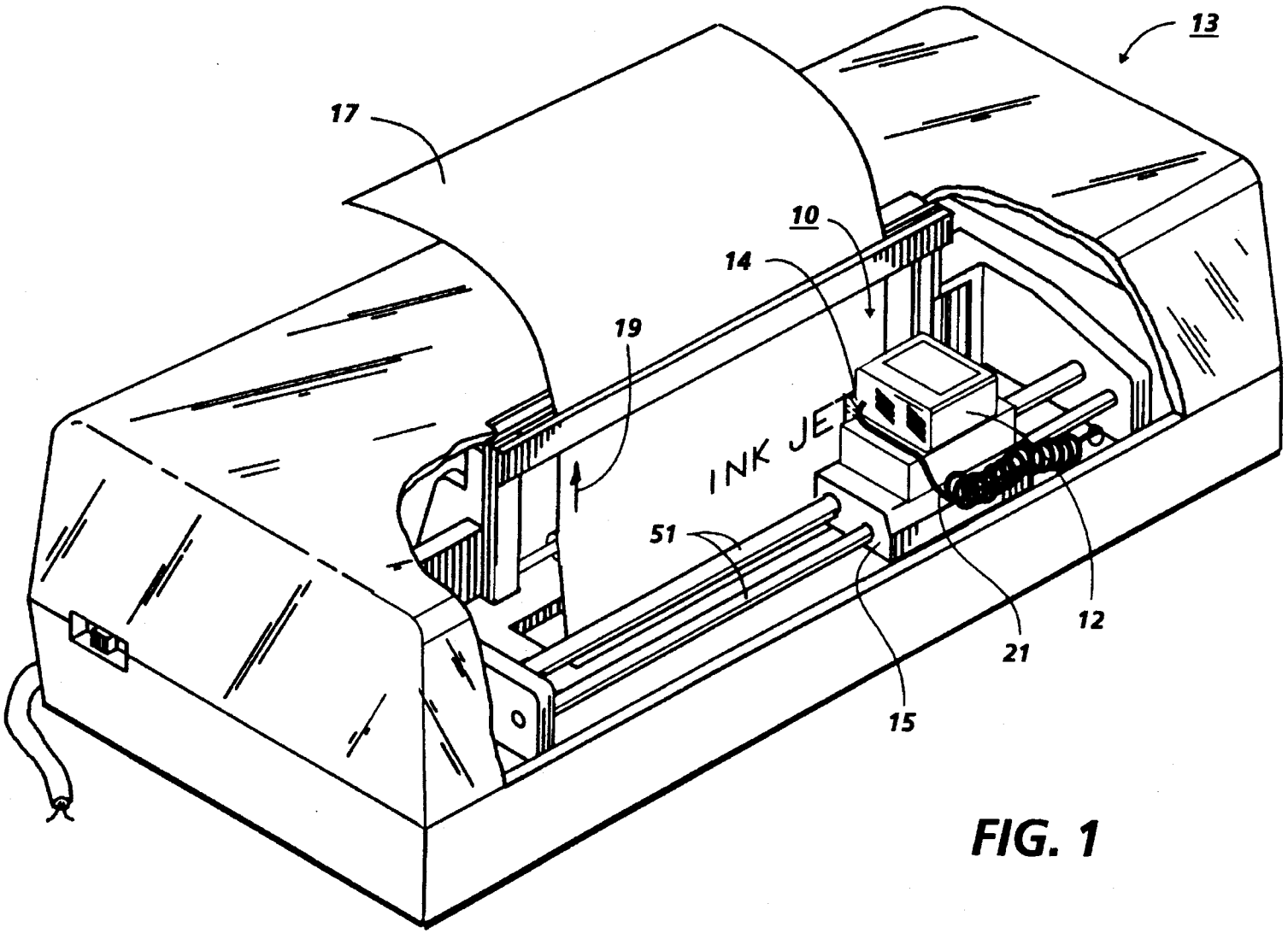
FIG. 1 is an isometric view of a thermal ink jet printer having the ink supply cartridge of the present invention.

FIG. 1 is a schematic, isometric view of a type of thermal ink jet printer 13 in which the printhead 14 and the ink supply therefor are combined in a single package, referred to hereinafter as cartridge 10. The main portion of cartridge 10 is the ink supply contained in housing 12, with another portion containing the actual printhead 14. In this embodiment of the invention, cartridge 10 is installed in a thermal ink jet printer 13 on a carriage 15 which is translated back and forth across a recording medium 17, such as, for example, a sheet of paper, on guide rails 51. During the translation of the printhead 14 by the carriage 15, the printhead moves relative to sheet 17 and prints characters on the sheet 17, somewhat in the manner of a typewriter. In the example illustrated, printhead 14 is of such a dimension that each translation of cartridge 10 along sheet 17 enables printhead to print with a swath defined by the height of the array of nozzles in printhead and the width of the sheet. After each swath is printed, sheet 17 is indexed (by means not shown) in the direction of the arrow 19, so that any number of passes of printhead 14 may be employed to generate text or images onto the sheet 17. Cartridge 10 also includes means, generally shown as cable 21, by which digital image data may be entered into the various heating elements (not shown) of printhead 14 to print out the desired image. This means 21 may include, for example, plug means which are incorporated in the cartridge 10 and which accept a bus or cable from the data processing portion (not shown) of the apparatus, and permit an operative connection therefrom to the heating elements in the printhead 14.

Figure 3:
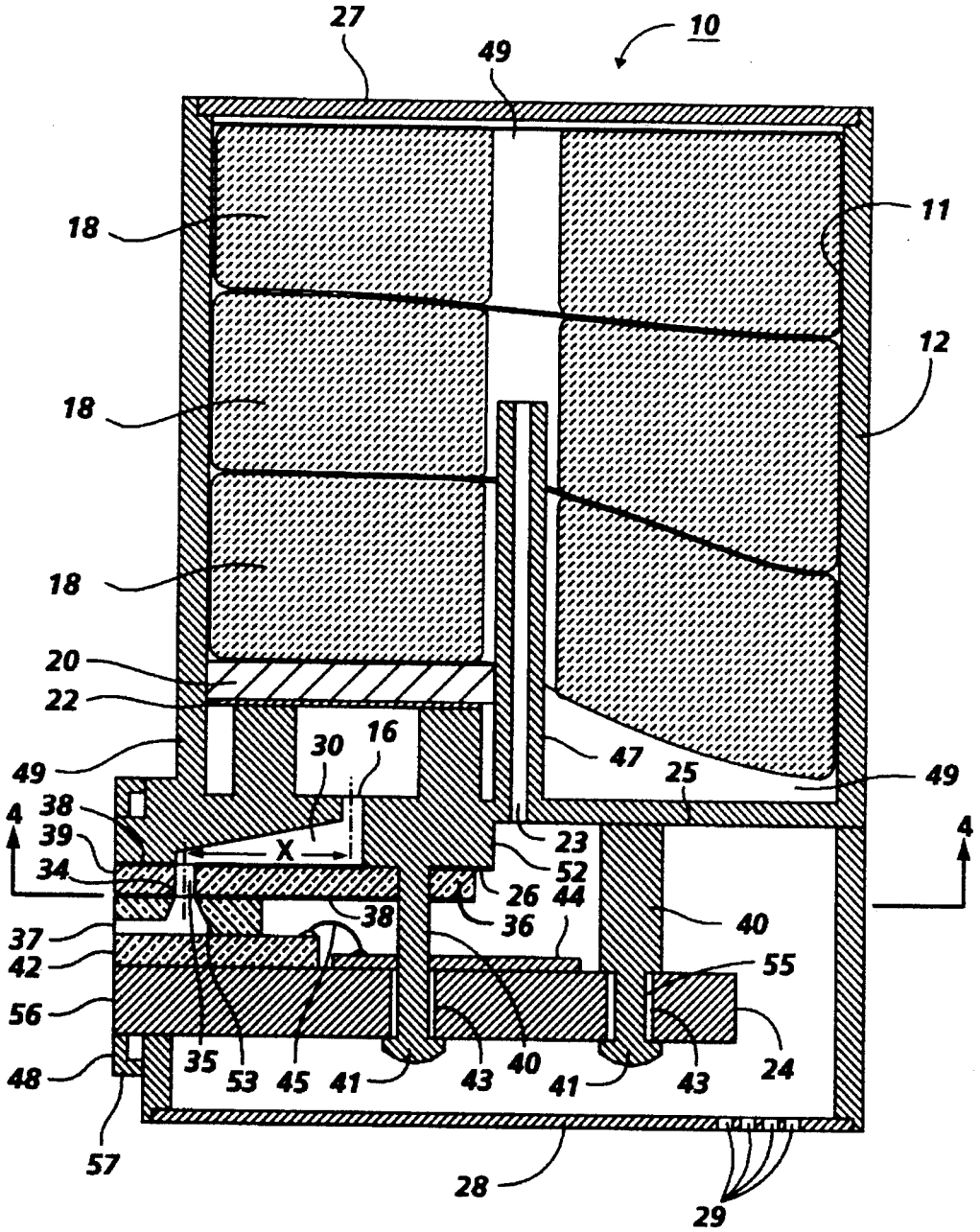
FIG. 3 is a schematic, cross-sectional elevation view of the cartridge in FIG. 2.

FIG. 3 is a schematic sectional, elevational view of cartridge 10. The cartridge 10 has a main portion in the form of a housing 12. Housing 12 is typically made of a lightweight but durable plastic. Housing 12 defines an internal chamber 11 for the storage of liquid ink having a wall 25 with a ventilation port or vent 23, open to the atmosphere, and an output port or outlet 16. An elongated recess or trench 30 of varying depth is formed in the outer wall surface 26, which extends from the wall 25 to increase the wall thickness, thereby forming a step 52 on the housing wall 25. The recess 30 may be integrally molded in the chamber wall surface concurrently with the fabrication of the housing 12. One end of the elongated recess 30 is connected to the outlet 16 and the other end terminates at a location which will align with the inlet 34 of the printhead when it is attached to the chamber wall 25. The distance "X" from the center of the outlet 16 to the center of the printhead inlet 34 is about 10 mm. The offset distance between x chamber outlet 16 and printhead inlet 34 is necessitated because the nozzles 54 in printhead nozzle face 55 must be closely spaced from the recording medium by, for example, a distance of about 20 mils. This spacing is within the warping or cockling dimension of the recording medium, such as paper, which is the typical response to wet ink on the surface thereof. Thus, the printhead nozzle face must be projected beyond the cartridge housing 12, so that the housing cannot contact or drag on the recording medium position having the recently printed wet ink images thereon. When the printhead is mounted so that the nozzles are projected from the cartridge, the printhead inlet is positioned beyond the cartridge housing. The recess 30, which provides the ink passageway between the ink supply in chambers 11 and the printhead 14, must be sized to accommodate an appropriate rate of ink flow in order to prevent lack of timely refill of the printhead reservoir and/or pressure surges which cause the nozzles to weep ink. This causes printhead malfunction. Accordingly, the ink flow inertance must be matched to the ink flow inertance of the printhead when it is printing. Inertance, is defined as the momentary pressures or pressure pulses generated by the acceleration of the fluid ink. In the preferred embodiment, the ink passageway between the printhead inlet 34 and ink supply chamber outlet 16 is geometrically shaped to have a cross-sectional flow area that increases from the printhead inlet to the chamber outlet. Though the preferred embodiment has only recess 30, a plurality of recesses could be provided. In addition to maximizing the rate of flow of ink to the printhead and matching the ink flow inertance, the increasing cross-sectional area enables any air bubbles in the recess 30 to to vent into the cartridge chamber, thereby keeping the passageway clear of flow impeding bubbles.

A relatively thin film member 36, having a predetermined shape and a slot 35 therethrough, is bonded to the wall surface 26, covering the recess 30 in the outer or external surface 26 of the chamber wall 25. The slot 35 is substantially the same size as the printhead inlet. The film member has opposing surfaces 31, 33, shown in FIG. 6, with the surfaces 31, 33 of the film member 36 coated with any suitable thermosetting adhesive 38. The adhesive 38 is in direct contact with the ink flowing through the passageway formed by the recess 30 and the film member 36, so that the adhesive should be insoluble in components utilized in the ink. Typical adhesives include combinations of phenolic resins or novolac (a thermoplastic phenolformaldehyde type resin obtained primarily by the use of acid catalysts and excess phenol) and nitrile rubber available from Coating Sciences, Inc. This type of adhesive prepared from phenolic resins and synthetic rubber gives a strong adhesive with considerable flexibility and has good impact resistance at room temperature. The properties of the components vary with the requirements for mechanical strength, flexibility, adhesion to specific surfaces, and durability. Phenolic resins are any of several types of synthetic thermosetting resin obtained by the condensation of phenol or substituted phenols with aldehydes, such as, formaldehyde, acetaldehyde, and furfural. Phenol-formaldehyde resins are typical and constitute the chief class of phenolics. Novolac is generally alcohol soluble and requires reaction with hexamethylenetetramine, p-formaldehyde, etc. for conversion to cured, cross-linked structures by heating at 200°–400° F. Nitrile rubber is a synthetic rubber made by random polymerization of acrylonitrile with butadiene by free radical catalysis. Refer to *Hawley's Condensed Chemical Dictionary*, eleventh edition, Copyright© 1987 by VanNostrand Reinhold. The phenolic nitrile adhesive thermosets into a medium hardness, rubber-like material after going through a temperature setting process. The adhesive should be resistant to outgassing during the curing process to prevent formation of bubbles or voids at the interface with the parts to be bonded and, when cured, remain flexible enough to prevent stress from being induced by the cartridge assembly or by the subsequent operating temperature fluctuations of the printhead. The cured adhesive should have a Shore A durometer of about 55. Such an adhesive is conformable, but will not migrate or wick, so that the adhesive will not flow into the slot in the film member or into the printhead inlet.

The film member 36 is bonded against the bottom or outer surface 26 of the housing chamber wall 25 by the adhesive 38 on surface 31 of the film member. The film member is shaped to avoid the locating and fastening pins 40 integrally formed or molded with the housing and used to fixedly attach the printhead 14 and heat sink 24, as discussed later. The elongated recess 30 is hermetically sealed by the film member to form a closed ink passageway from the cartridge chamber 11 to the printhead nozzles 37.

Figure 7:
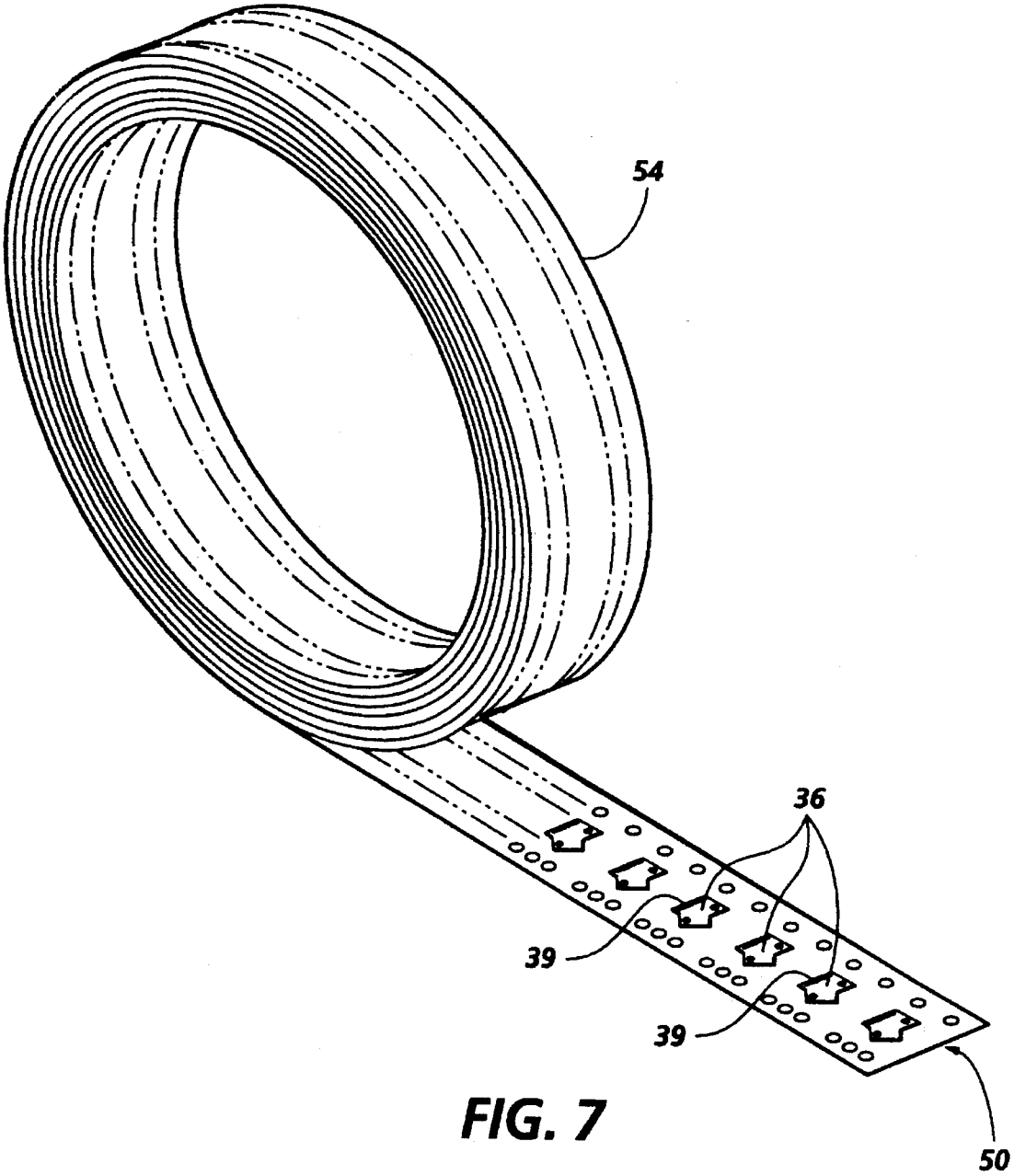
FIG. 7 is a schematic, isometric view of a roll of carrier strip containing a plurality of shaped film member releasably held thereon.

The film member is fabricated by coating the desired adhesive on both sides of a strip of polyester film, such as Mylar®, having a thickness of about 4 to 10 mils and preferably 7 mils. The coated raw material is then laminated to a 2 to 6 mils thick, preferably 3 mils thick, polyester release carrier strip 50 (see FIG. 7) on the side which will bond to the chamber wall with a thinner polyester paper release cover (not shown) on the other side. A thinner release cover is about 1.5 mils thick. A progressive punching operation is used to first punch through the critical features of ink slot and front edge 39 which is coplanar with the printhead nozzle face 42 and then the remaining profile or periphery of the film member 36 is just scored to a depth of only 1 mil into the polyester release carrier strip 50. Only the film members 36 are left on the carrier strip equally spaced therealong with the thinner release cover (not shown) thereover, when the scrap matrix of 7 mil thick film strip and thinner release cover is removed leaving a complete film member 36 spaced every 1.5 inches down a 4,000 inch long polyester carrier strip 50 rolled on a spool or reel 54. The reel of scored film members are fed into a pick and place zone of a robotic device (not shown) and the film members 36 are vacuum picked off the carrier strip 50, positioned to the housing wall surface 26 using a vision system (not shown), and placed onto the housing wall surface 26 with a specified pressure. The thinner release cover is then removed by either a higher tack tape or mechanical picker (neither shown) and the printhead 14 and bonded heat sink 24 as an assembly 46 is aligned and placed onto the awaiting film member. The printhead 14 is bonded to the heat sink 24, so that the printhead inlet 34 is facing in a direction perpendicular to the heat sink. A printed circuit board 44 is also bonded to the heat sink adjacent the printhead. The terminals or contact pads (not shown) of the printhead 14 and circuit board 44 are interconnected by wire bonds 45. Locating holes 43 in the heat sink are used when mounting the printhead and heat sink assembly 46 to align the printhead inlet and nozzle face relative to the housing by inserting the housing stake pins 40 therein. The locating holes 43 are larger than that portion of the stack pins 40 residing therein. The space 55 therebetween is filled with an appropriate adhesive (not shown), such as, for example, a UV curable adhesive and cured by exposure to UV light. The stake pin ends 41 are then ultrasonically staked to form pin heads 41 and the attachment of the printhead and heat sink assembly is complete.

Figure 2:
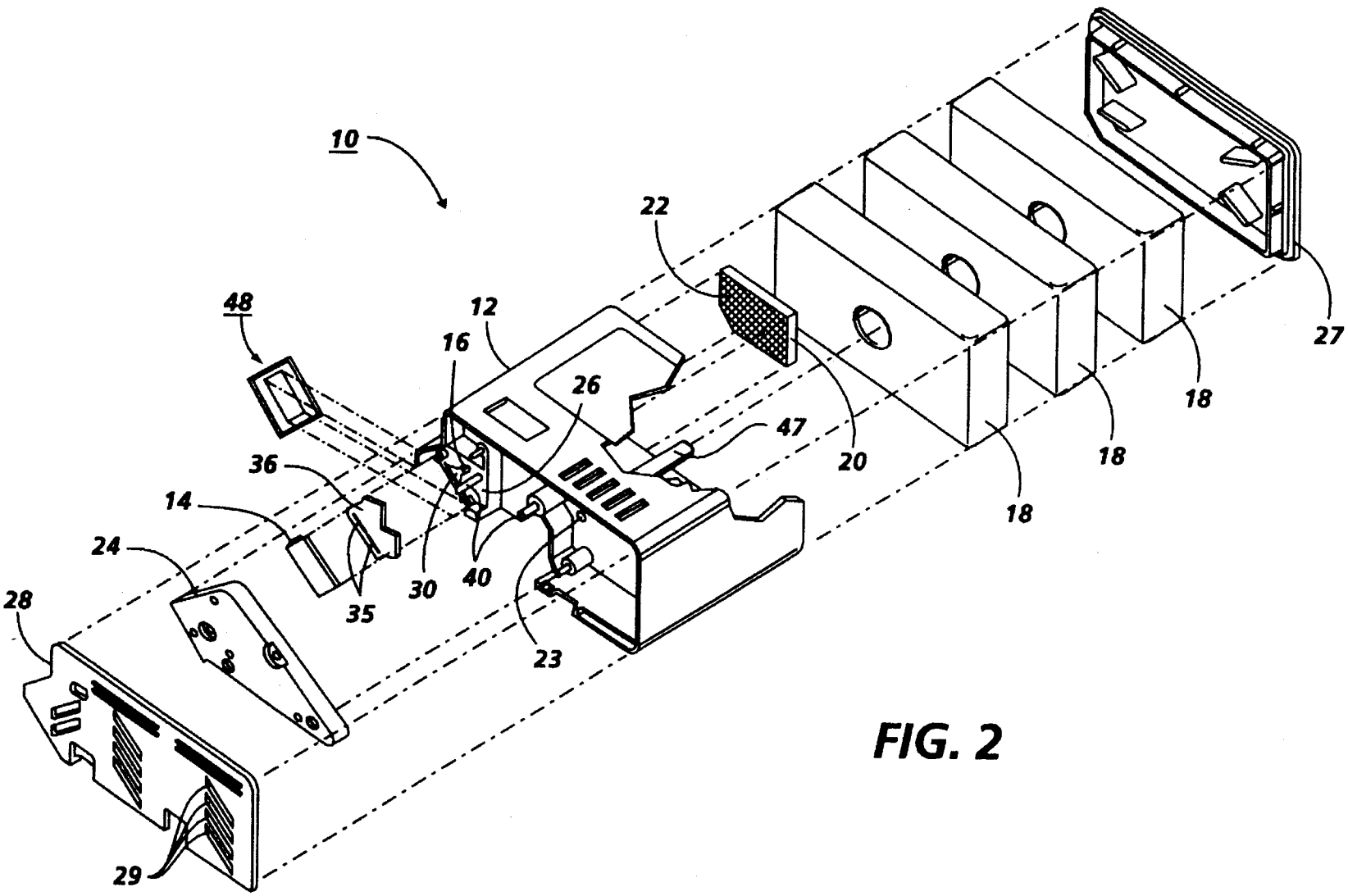
FIG. 2 is an exploded view of the ink supply cartridge of FIG. 1, showing the shaped film member that concurrently completes the ink flow passage from the outlet in the cartridge wall to the printhead inlet and seals the printhead to the cartridge.

The nozzle face 42 of the printhead 14 is coplanar with the edge 56 of the heat sink 24 and a portion of the upper edge of the housing chamber wall 25. This region of the cartridge 10 is covered by a rectangular shaped frame or face plate 48 having a lip 57 around the outer edge thereof and extending in a direction towards the housing. The void area between the frame and the housing is filled with a thermally curable passivation material (not shown) to form a hermetic seal completely around the printhead. The wire bonds 45 are encapsulated with the same thermally curable passivation material (not shown) as used around the face plate 48 by, for example, an injection syringe, which fills the cavity behind the printhead and covers the wire bonds. The housing 12 and attached printhead and heat sink assembly 46 is cured in an oven, thus simultaneously curing the thermosetting adhesive 38 and the wire bond encapsulating passivation material. Referring also to FIG. 2, an exploded isometric view of the cartridge 10, the various elements of the cartridge may be viewed which forms a compact customer replaceable unit. Cosmetic bottom cover 28 with ventilation openings 29 is positioned on the housing over the printhead and heat sink assembly 46 and ultrasonically welded to the housing.

The ink holding medium 18 is shown as three separate portions, occupying most of the chamber 11. The ink holding medium is saturated with ink and the top housing cover 27 of the same durable plastic material as the housing is placed on the housing and ultrasonically welded thereto. A tube 47 extends from the vent 23 to center of the interior of chamber 11 in the housing and through openings in each of the ink holding mediums. As is well known in the industry, the printheads will have on-board circuitry for selectively activating the heating elements (not shown) of the thermal ink jet printhead 14 as addressed by electrical signals for the printer controller (not shown) which connects to the cartridge printed circuit board 44 by the cable 21 (FIG. 1) when the cartridge is installed on the carriage 15.

In the preferred embodiment of the invention, medium 18 (shown as three portions of material) is in the form of a needled felt of polyester fibers. Needled felt is made of fibers physically interlocked by the action of, for example, a needle loom, although in addition the fibers may be matted together by soaking or steam heating. According to the preferred embodiment of the present invention, the needled felt should be of a density of between 0.06 and 0.13 grams per cubic centimeter. It has been found that the optimum density of this polyester needled felt forming medium 18 is 0.095 grams per cubic centimeter. This optimum density reflects the most advantageous volume efficiency, as described above, for holding liquid ink. A type of felt suitable for this purpose is manufactured by BMP of America, Medina, N.Y.

Medium 18 is packed inside the chamber 11 of housing 12 in such a manner that the felt exerts reasonable contact and compression against the inner walls. In one commercially-practical embodiment of the invention, the medium 18 is created by stacking three layers of needled felt, each one-half inch in thickness, and packing them inside the housing 12.

Also within housing 12 is a member made of a material providing a high capillary pressure, indicated as scavenger 20. Scavenger 20 is a relatively small member which has a capillarity higher than that of medium 18 and serves as a porous capillary barrier between the medium 18 and the output port 16, which leads to the passageway formed by the recess 30 in the chamber wall 25 and the film member 36. Scavenger 20 may be an acoustic melamine foam, one suitable type of which is made by Illbruck USA, Minneapolis, Minn., and sold under the trade name "Wiltec." The scavenger 20 preferably further includes a filter cloth, indicated as 22, which is attached to the melamine using a porous hot-melt laminating adhesive. In general, the preferred material for the filter cloth 22 is monofilament polyester screening fabric.

In FIG. 3, it can be seen that one portion of the outer surface of scavenger 20 abuts the ink holding medium 18, while other portions of the surface are exposed to open space 49 between the medium 18 and the inner walls of chamber 11. The single chamber 11 is so designed that a given quantity of ink may conceivably flow from the medium 18 to and through the scavenger 20, which has a higher capillarity than the medium 18, and through the filter 22, which has a higher capillarity than the scavenger, to the outlet 16 and through the passageway formed by the elongated recess 30 and film member 36 to the printhead inlet 34.

Figure 4:
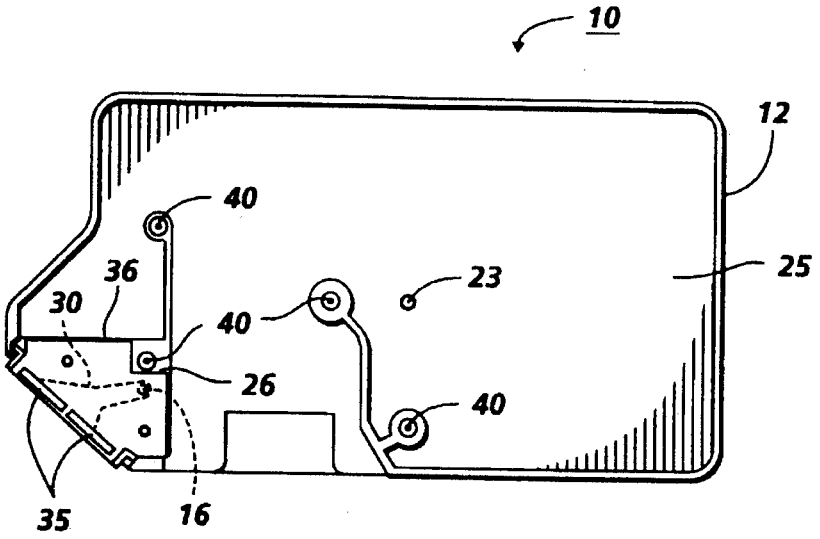
FIG. 4 is a cross-sectional plan view of the cartridge in FIG. 3 as viewed along line 4—4 therein.
Figure 5:
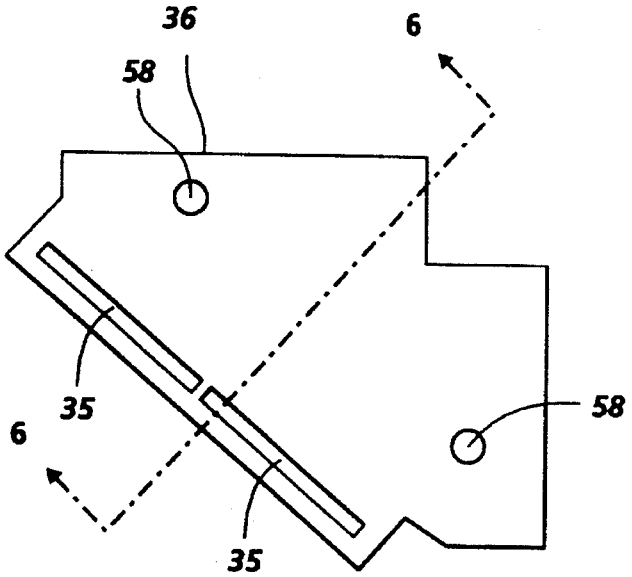
FIG. 5 is a plan view of the shaped film member shown member in FIGS. 2 and 3.
Figure 6:
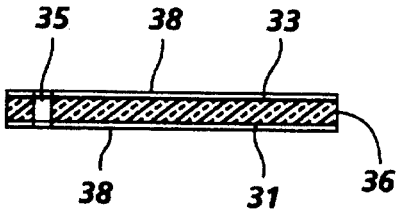
FIG. 6 is a cross-sectional view of the shaped film member as viewed along section line 6—6 of FIG. 5.

FIG. 4 is a bottom view of the housing 12 as viewed along view-line 4—4, and shows the geometric shape of the film member 36 required to fit the shape of the housing wall surface 26 in this region of the housing wall 25 and to avoid stake pins 40. The film member is bonded to the surface 26 of housing wall 25 and covers the recess 30 and outlet 16 connected thereto, shown in dashed line. The passageway formed by the recess 30 and film member 36 terminates at the through slot 35, which is similar in size and shape as the printhead inlet 34. Thus, the passageway transitions to the relatively thin slot, so that the thermosetting adhesive 38, preferably phenolic nitrile, on the film member surface 33 that surrounds the printhead inlet 34 also provides the fluidic seal between the housing and the printhead. FIG. 5 shows the film member 36 with through slots 35, and holes 58, which are used by an end effector of a robot (not shown) to align the end effector therewith. The robot removes the film member 36 from the carrier strip 50 of FIG. 7 and places it on the wall surface portion 26 of the housing 12. FIG. 6 is a cross-sectional view of the film member in FIG. 5 as viewed along section line 6—6, and shows the film member slot 35, surfaces 31, 33 with the thermosetting adhesive 38, preferably phenolic nitrile, thereon.

As is evident in FIGS. 3–6, the ink must flow against the exposed thermosetting adhesive 38 on surface 31 of the film member 36. This adhesive should be insoluble in components utilized in the ink; otherwise, the ink would be contaminated by the adhesive and the adhesive eroded so that the ink may leak between the housing wall surface 26 and the film member 36. Once the film member 36 is positioned on surface 26 of housing wall 25, the adhesive 38 is heated to about 80° C. for about eight seconds at 50–90 psi to soften the adhesive. The softened adhesive conforms and wets all of the bonding surfaces of the housing wall. The adhesive 38 is then allowed to cool to room temperature and return to its original consistency, thereby firmly tacking the film member 36 to the housing wall surface 26. During the softening or fully curing heating process, the adhesive conforms, but does not migrate or wick. The softened and then cooled adhesive bonds the film member to the housing wall with enough strength to prevent relative movement therebetween when the printhead and heat sink assembly is assembled on the housing and against the film member. Accordingly, the final curing process for the adhesive does not cause the adhesive to flow into the slot 35 in the film member or onto the nozzle face 42 of the printhead 14, either during or after assembly of the cartridge 10.

The thermosetting adhesive 38 is fully cured without pressure by heating the cartridge in an oven to a temperature of about 150° C. for about 60 minutes. This temperature is well within the temperature range of common plastic material such as that used for the cartridge housing 12, so that the curing of the thermosetting adhesive 38 will not affect the housing. The thermosetting adhesive 38, such as phenolic nitrile, thermosets into a flexible, medium hardness, rubber-like material having a hardness of about Shore A durometer of 55. The passivation material for the wire bonds and the sealing adhesive around the frame 48 which surrounds the printhead face and heat sink edges 56 are concurrently cured with the film member adhesive 38.

Many modifications and variations are apparent from the foregoing description of the invention and all such modifications and variations are intended to be within the scope of the present invention.

We claim:

1. A liquid ink supply cartridge for an ink jet printer containing ink therein and including a printhead with nozzles and an ink inlet, comprising:

a housing having a chamber with liquid ink, the chamber having a vent and a wall, the wall having internal and external surfaces and an outlet therethrough;

a recess in the external surface of the chamber wall connected to the chamber outlet;

a flexible film member having a predetermined thickness and shape and a slot therethrough at a predetermined location, the film member having first and second surfaces coated with a phenolic nitrile thermosetting adhesive highly resistant to attack by the ink, the first surface of the film member being sealingly bonded to the external surface of the chamber wall, so that the recess and outlet are covered by the film member to form a passageway from the outlet to the film member slot; and said printhead being sealingly bonded to the second surface of the film member with the film member slot being aligned with the printhead inlet.

2. The cartridge of claim 1, wherein the film member is a film forming polymer having thickness of 4 to 10 mils.

3. The cartridge of claim 2, wherein the film forming polymer is a polyester material.

4. The cartridge of claim 3, wherein the adhesive on the first and second surfaces of the film member is highly resistant to outgassing when the adhesive is being cured, so that no bubbles are formed which interfere with the adhesive bonding or sealing; and wherein the adhesive is flexible after being fully cured, so that stresses induced by the assembly of the cartridge and by the printhead operating temperature fluctuations are prevented.

5. The cartridge of claim 4, wherein the cured adhesive has a Shore A durometer of about 55.

6. The cartridge of claim 4, wherein the adhesive on both sides of the film member prior to the film member being installed on the chamber external surface is a dried mixture of phenolic resin and nitrile rubber in a solvent, so that the solvent is substantially removed.

7. The cartridge of claim 6, wherein the dried adhesive has a residual solvent content of less than 0.05%.

8. The cartridge of claim 6, wherein the dried adhesive is conformable but does not migrate when heated.

9. The cartridge of claim 8, wherein the adhesive softens and wets the chamber wall surface having the recess therein at a temperature of 80° C. for about eight seconds with a pressure of about 50–90 psi; and wherein the adhesive tacks the film member to the chamber wall when the adhesive cools to room temperature to prevent movement of the film member relative to the external wall surface of the housing.

10. The cartridge of claim 1, wherein the phenolic nitrile includes the combination of a phenolic resin and nitrile rubber.

11. The cartridge of claim 1, wherein the phenolic nitrile includes the combination of novolac and nitrile rubber.

* * * * *